US012687007B2

(12) United States Patent
De Rycke et al.

(10) Patent No.: US 12,687,007 B2
(45) Date of Patent: Jul. 21, 2026

(54) TERRACE CANOPY AND METHOD FOR PRODUCING SAME

(71) Applicant: RENSON OUTDOOR, Kruisem (BE)

(72) Inventors: Thomas De Rycke, Ghent (BE); Kristof Lemiegre, Gentbrugge (BE)

(73) Assignee: RENSON OUTDOOR, Kruisem (BE)

( * ) Notice: Subject to any disclaimer, the term of this patent is extended or adjusted under 35 U.S.C. 154(b) by 156 days.

(21) Appl. No.: 18/685,738

(22) PCT Filed: Aug. 23, 2022

(86) PCT No.: PCT/IB2022/057877
§ 371 (c)(1),
(2) Date: Feb. 22, 2024

(87) PCT Pub. No.: WO2023/026178
PCT Pub. Date: Mar. 2, 2023

(65) Prior Publication Data

US 2024/0360659 A1 Oct. 31, 2024

(30) Foreign Application Priority Data

Aug. 27, 2021 (BE) ..... 2021/5677

(51) Int. Cl.
*E04B 1/24* (2006.01)

(52) U.S. Cl.
CPC .... *E04B 1/2403* (2013.01); *E04B 2001/2421* (2013.01); *E04B 2001/2454* (2013.01)

(58) Field of Classification Search
CPC ..... E04C 3/07; E04C 2003/0413; E04C 2003/0439; E04C 2003/0465; E04D 2013/0893; E04D 13/08; E04D 13/064; E04F 10/0685; E04H 6/025; E04B 2001/2409; E04B 2001/2451
See application file for complete search history.

(56) References Cited

U.S. PATENT DOCUMENTS 880,285 A * 2/1908 Eberhard ..... E04B 1/185 52/283
949,394 A * 2/1910 Daly ..... E04B 1/2403 296/9
1,024,615 A * 4/1912 Brown ..... E04B 1/24 403/268
2,970,676 A * 2/1961 Maciunas ..... E04B 1/24 52/262

(Continued)

FOREIGN PATENT DOCUMENTS

EP 3135837 A1 3/2017
WO 2021214670 A1 10/2021
WO 2021214673 A1 10/2021

*Primary Examiner* — Gisele D Ford
(74) *Attorney, Agent, or Firm* — FisherBroyles, LLP; Roger L. Browdy; Ronni S. Jillions

(57) ABSTRACT

A terrace canopy comprising a column and a beam (5), the beam being supported by the column (70) at a position between its ends and the beam, at that location, having a recess (100) such that two to facing ends (103, 104) are present in the beam. Fastening means in the form of headboards (60) are provided between the ends of the beam and the column for attaching the beam to the column. The headboards each form a fastening element without a folding line, which creates a stronger connection between the column and the beam.

14 Claims, 13 Drawing Sheets

(56) References Cited

U.S. PATENT DOCUMENTS

| | | | | | |
|---|---|---|---|---|---|
| 3,222,841 | A * | 12/1965 | Lipof | E04C 3/06 | 52/63 |
| 4,723,384 | A * | 2/1988 | Mengeringhausen | E04B 1/24 | 52/646 |
| 5,289,665 | A * | 3/1994 | Higgins | E04B 5/43 | 52/655.1 |
| 5,494,370 | A * | 2/1996 | Habicht | F16B 7/0446 | 403/231 |
| 5,618,127 | A * | 4/1997 | Tonsmann | E06B 3/9616 | 403/403 |
| 5,680,737 | A * | 10/1997 | Sheipline | F16B 7/0453 | 403/205 |
| 8,297,023 | B2 * | 10/2012 | Collins | E04B 1/24 | 52/704 |
| 9,605,425 | B1 * | 3/2017 | Hendry | E04B 1/2403 | |
| 9,932,734 | B1 * | 4/2018 | Winter | E04B 1/1903 | |
| 10,174,498 | B2 * | 1/2019 | Winter | E04B 1/388 | |
| 10,316,508 | B1 * | 6/2019 | Hendry | E04B 1/5831 | |
| 10,676,936 | B2 * | 6/2020 | Lemiegre | E04F 10/00 | |
| 11,753,862 | B2 * | 9/2023 | Johnson | E06B 1/52 | 52/210 |
| 2003/0041549 | A1 * | 3/2003 | Simmons | E04B 1/2403 | 52/655.1 |
| 2006/0165482 | A1 * | 7/2006 | Olberding | E04B 1/24 | 403/381 |
| 2006/0265992 | A1 * | 11/2006 | Hiragaki | E04B 5/43 | 52/633 |
| 2008/0053020 | A1 * | 3/2008 | Collins | E04B 1/24 | 52/282.4 |
| 2010/0071305 | A1 * | 3/2010 | Collins | E04B 1/24 | 52/704 |
| 2018/0094418 | A1 * | 4/2018 | Winter | E04B 1/5831 | |
| 2018/0094426 | A1 * | 4/2018 | Winter | E04F 11/1817 | |

* cited by examiner

TERRACE CANOPY AND METHOD FOR PRODUCING SAME

TECHNICAL FIELD

The present invention relates to a terrace canopy. The present invention also relates to a method for producing such a terrace canopy.

STATE OF THE ART

Terrace canopies are usually arranged to screen off or, on the contrary, to clear an outdoor area. For example, such terrace canopies are often arranged at houses, restaurants, shops, etc. in order to screen an outdoor terrace or the like from sun rays, precipitation and/or wind or, alternatively, to temporarily let in sun rays. These terrace canopies can, for example, be implemented in the form of canopies, pergolas, verandas, carports, a pavilion, etc.

Such a terrace canopy typically comprises a roof frame which is at least partially supported by columns. The roof frame is generally constructed from several beams that are assembled into one or more frames into which a roof infill can be attached. The beams themselves are often a composite of several individual profiles. Such a roof frame is typically supported by four (or more) columns between which a wall infill can be provided. Also, fewer columns can be used in case the roof frame is supported by other structures, such as a wall of an already existing structure.

The roof infill can be stationary or movable, for example a sliding roof. The roof infill of a sliding roof can, for example, consist of a roll-up cloth or screen, blades that rotate around their axis, or of segments that can slide over each other. The segments can be panels that are partly made of (laminated) glass or plastic, such as PC or PMMA. Depending on the choice of material, the light transmission and robustness of the roof can be adjusted to the desired application. The wall infill can also be stationary or movable. Examples are a rollable cloth or screen or movable, i.e. slidable or foldable, panels.

Furthermore, various types of columns have been developed that, in addition to their general support function, contain other functions. For example, the columns may be adapted to also provide supply lines to electrical equipment and/or to comprise drainage pipes for drainage of precipitation and/or to comprise guide profiles for a screen. Preferably, the column should be able to comprise all of the functions described above and also be finished as aesthetically as possible from the outside.

Typically, the roof frame of a terrace canopy is supported by a column at each corner point. For example, in the simplest arrangement, the roof frame is rectangular and each of the four corners is supported by a column. However, terrace canopies are also known wherein the column is shifted relative to a corner point of the roof frame. In other words, the beam forming part of the roof frame is supported somewhere along its length by the shifted column and is no longer supported at its corner point. The corner point therefore has a floating view. To obtain such a shifted column, a recess is typically milled into the beam. The column, or at least the upper part thereof, is then placed into the recess. Thereafter, the column is connected to the beam by two or more support brackets, e.g. L-shaped support brackets. Thereby, one part of each support bracket is attached to the column and the other part to the beam.

A disadvantage of such a construction is the bearing capacity of the terrace canopy. All forces between the beam and the shifted column must be carried by the brackets. Especially in view of the possible variation in roof infill and/or wall infill in combination with variable loads (wind, precipitation, etc.), very high forces can be exerted on the brackets, which can cause deformation and/or damage.

Also, each leg of the brackets must be attached to the column or the beam by means of bolts and/or screws. In other words, the necessary walls must be available for this purpose and openings must be made or must be present in those walls. Making those openings during assembly is not only time-consuming, but can also lead to a less optimal construction, for instance a deviating alignment between the beam and the column. Applying the openings in advance has the disadvantage that non-standard parts have to be manufactured.

In addition, depending on the design of the terrace canopy, it is not always possible to mount the brackets without fastening means visible on the outside of the terrace canopy, while such fastening means are not desirable.

An additional difficulty here is that the beam can typically only be milled out over a very small part of its cross-section if an internal water drainage is provided in the beam. The internal water drainage cannot simply be interrupted because this can lead to leaks that can cause water damage.

DESCRIPTION OF THE INVENTION

It is an object of the present invention to provide a terrace canopy with a shifted column that can withstand higher loads.

This object is achieved by a terrace canopy comprising: a column extending in particular in a substantially vertical direction; a beam extending in particular in a substantially horizontal direction between a first end and a second end, wherein the beam is supported by the column at a location between said ends and wherein the beam, at said location, is provided with a recess, which recess divides the beam into a first and a second beam portion, wherein the first beam portion extends between the first end and a third end and the second beam portion extends between the second end and a fourth end, wherein the recess is located between the third end and the fourth end; and fastening means between the beam and the column for securing the beam to the column, wherein the fastening means comprise: a first headboard secured onto said third end and onto said column; and a second headboard secured onto said fourth end and onto said column.

The invention is mainly based on the use of a headboard to replace the known brackets. The current inventors came to the conclusion that the brackets were particularly fragile due to their design, whereby one or more folding lines are present between the elements attached to each other (i.e. beam and column). According to the present invention, the headboards are attached to the end of a beam portion and they actually form a front side wall of the beam portion, which front side wall is in turn attached to the column. In other words, the headboards form a (mainly plate-shaped) element that is connected on one side to the beams and on the opposite side to the column. Hence, there is no need for a fastening element with a folding line between the fastening with the beam and the fastening with the column, as is the case with the current brackets. Due to the absence of the folding line in the fastening means (i.e. in the headboards) there is a stronger connection between the column and the beam that can withstand higher loads.

In an embodiment of the present invention, the first beam portion and the second beam portion each comprise a plurality of fastening channels each extending in a longitudinal direction of the beam, wherein each headboard at its respective end is attached by a plurality of fastening means, such as bolts and/or screws, extending through the headboard into the fastening channels. Preferably, the fastening channels in the first beam portion and the fastening channels in the second beam portion are aligned with each other.

The use of fastening channels (for example fastening channels or bolt channels) is an advantageous way of attaching a headboard to a front end of a beam portion, because the bolts and/or screws can be placed easily and quickly through the headboard in the fastening channel intended for that purpose. In addition, this leads to a very strong connection, especially compared to other fastening means such as clips. If the fastening channels are aligned with each other, they can also be manufactured integrally with the rest of the beam, for instance during an extrusion process.

In one embodiment of the present invention, the beam comprises a continuous profile, wherein part of the continuous profile is uninterrupted over the entire length of the beam. Preferably, the continuous profile comprises, in its cross-section, an L-shaped part, which L-shaped part is uninterrupted over the entire length of the beam.

A continuous profile is beneficial for a number of reasons. First of all, it allows to attach the roof infill unchanged to the beam, also at the location of the recess in which the shifted column fits. Furthermore, the continuous profile ensures that the strength and bearing capacity of the beam (partly) continues over the column. It is further advantageous that the continuous portion is L-shaped, because this portion then contributes to a large extent to the strength and rigidity of the beam. In this case, one leg of the L-shaped part can be located above the column and the other leg alongside the column.

In one embodiment of the present invention, each of the ends defines a plane, which planes are substantially parallel to each other and, in particular, are substantially perpendicular to a longitudinal direction of the beam. With each end is referred to both the ends of the beam as well as the ends of each beam portion adjacent to the recess. By using mutually parallel planes, it is possible to attach the same headboard at different ends. The fastening channels that are aligned with each other also contribute thereto. By being able to use the same part at multiple locations, the number of parts to be produced is reduced, such that production can be carried out more efficiently and cheaper. Planes which are perpendicular to the substantially horizontal direction are advantageous because the column can then have, for example, a rectangular or square cross-section and this with plate-shaped headboards. In the case of planes oriented differently, the column must have a different cross-section and/or the headboards must compensate this. However, all this then typically leads to obliquely oriented fastening means, which is less optimal in terms of load distribution.

In an embodiment of the present invention, the column comprises a connection element and a support column, which connection element is secured to the support column and to said headboards. Preferably, the connection element is located substantially entirely in the recess in the beam.

Non-integrally producing the column has a number of advantages. Firstly, different production techniques can be used for the support column and the connection element or they can have a completely different shape (e.g. a different extrusion mould) notwithstanding that the same production process is used. In addition, the height of the terrace canopy can be adjusted more easily by simply varying the length of the support column. By placing the connection element substantially entirely into the recess, it can also be hidden from view, for instance by placing finishing elements on the beams and the support column.

In one embodiment of the present invention, the connection element comprises an upper part onto which the headboards are secured, wherein one or more support legs extend from the upper part to the support column. Preferably at least one and in particular each support leg is secured to the support column, more preferably to an upper face of the support column, in particular by means of fastening means, such as bolts or screws, extending through the entire support leg. Preferably, each support leg is formed by a rod element, such as a hollow rod element.

The support legs form a simple way of bridging the difference in height between the connection of the connection element to the beam parts and the connection of the connection element to the support column, thereby leaving passages open for water drainage. This height difference is typically present such that the gutter of the beam (portions), in particular the internal trough of the beam (portions), can communicate with an internal cavity of the support column and/or communicate with each other. Due to the support legs, the connection element is also formed more simply with a minimum of openings. Attaching the support legs to the top surface of the support column provides better power transfer between the support legs and the support column as compared to support legs attached to a side wall of the support column. Moreover, the securing means extending through the support legs provide for easy mounting since they can be arranged from the top side of the corner connection element. Also in this way, it is avoided that additional elements have to be placed between the support legs and the support column, in other words, there is a direct connection there between. The use of the support legs for attachment to the support column is advantageous since the support legs then perform a double function, namely securing and bridging the difference in height. A hollow rod element is advantageous as it allows attachment to the support column by means of fastening means extending through the support legs.

In a first preferred embodiment of the present invention, the first and the second beam portion are provided with a gutter for discharging precipitation falling on the terrace canopy to the third and fourth end, respectively, wherein the first and second headboards are provided with a passage and wherein the connection element is provided with a first and a second passage, which passages allow a gutter of the first beam portion to communicate with a gutter of the second beam portion.

In this way, there is a passage of collected precipitation from the first beam portion to the second beam portion (or vice versa). This passage can then be discharged to a ground surface at a different location in the roof frame. The advantage of this embodiment is that there is no need for a water discharge in the shifted column.

In a second preferred embodiment of the present invention, the first and/or the second beam portion is provided with a gutter for discharging precipitation falling on the terrace canopy to the third and fourth end, respectively, wherein the support column is provided with a cavity for discharging the precipitation falling on the terrace canopy towards a ground surface and wherein the first and/or the second headboard is provided with a passage and wherein the connection element is provided with a first and/or a second passage, which passages allow a gutter of the first and second beam portion, respectively, to communicate with the cavity of the support column.

In this way there is a discharge of collected precipitation from the first beam portion and the second beam portion to the cavity in the support column. The advantage of this embodiment is that the terrace canopy can discharge a higher amount of precipitation at a specific moment. This is because several discharge points are possible, and in particular also in the shifted column.

In each of these preferred embodiments, it is possible to discharge precipitation, incident on the terrace canopy, to a ground surface via the beams (and the support column) without the need for externally visible drainage pipes. The passages are, preferably, formed between the support legs such that, during manufacture of the connection element, no additional operations are required to make the passages.

It will be readily appreciated that in each of these preferred embodiments, the gutter serving as a water outlet is interrupted near the shifted column. This interruption is made possible by the use of headboards which are shaped such that each gutter part adjoins the respective headboard, which in turn connects to the connection element. Leaks are thus avoided. Such an interruption of the gutter, in particular internal gutter, is technically not feasible with the known support brackets. Since, according to the invention, the gutter of the beam can be interrupted, the recess in the beam can also be made much larger (in particular extend over a much larger transverse area of the beam) such that a larger contact area is possible between beam portions, headboards and connection element (or column). A larger contact surface is advantageous for obtaining a strong connection that can withstand high loads.

In an embodiment of the present invention, the connection element comprises an upper part to which the headboards are secured, which upper part of the connection element is provided with at least two wall portions, wherein each headboard is attached against a wall portion of the connection element. Preferably, mutually cooperating alignment means are provided between each wall portion and the headboard attaching thereto, which mutually cooperating alignment means are configured for aligning a headboard with respect to the support column.

The upper part provides a firm connection between the beam portions, wherein the bearing loads are then preferably exerted on the support column by means of the support legs. In addition, the two wall portions ensure that the different connections to the beam portions do not influence each other. Furthermore, the wall-to-wall attachment between the headboards and the connection element is advantageous because it results in a maximum contact surface for transmitting pressure forces, for instance due to lateral wind loads. By providing mutually cooperating alignment means between each wall portion and the headboard attached against it, the mutual placement between the headboard and the wall portion is correct (or at least better than in the absence of the alignment means). Because the headboard is secured to the beam (portions) and because the connection element is fixed to the support column (or is integrally formed therewith), the positioning of the beam portion in relation to the support column is therefore also correct (or at least better than in absence of the alignment means). Such mutually cooperating alignment means have already been described in BE2021/5460, which patent application has not yet been published at the time of filing of the present patent application.

Preferably, the mutually cooperating alignment means comprise a tongue and groove. Preferably, the tongue and groove extend in a longitudinal direction of the column and/or have mutual contact surfaces which are oriented obliquely with respect to the corresponding wall portion.

Such a tongue and groove ensure that the alignment means ensure alignment at several different locations of the headboard. This is in contrast to, for example, a pin-hole as alignment means, which only provide alignment at one place. By ensuring a mutual alignment at several, in particular at least two, separate locations of the headboard and the wall portion, a rotation between the beam portion and the support column is avoided (or at least limited). Extending in the vertical direction is advantageous for the manufacture of the connection element. Such a tongue and groove can, in fact, be produced immediately during the extrusion process for producing the connection element. This thus saves additional producing steps. The provision of obliquely oriented contact surfaces offers an easy installation and ensures a close connection compared to contact surfaces that are perpendicular to the wall portion. In particular, with right-angled contact surfaces, the headboard must be perfectly aligned with the wall portion of the connection element before installation, which is not easy. In addition, clearance must still be provided at right angle contact surfaces to accommodate producing tolerances. With angled contact surfaces, the initial alignment is not crucial, which simplifies installation. In particular, when the connection (e.g. the bolt) is tightened, the oblique contact surfaces automatically close against each other.

In an embodiment of the present invention, the connection element is integrally formed, preferably by means of an extrusion process, and/or each headboard is integrally formed, preferably by means of a moulding process, and/or the connection element exhibits a rotational symmetry of order three, preferably four or higher.

An integrally formed connection element is preferred in view of the higher rigidity and the reduction of assembly work compared to a connection element consisting of several pieces. If necessary, additional producing steps may subsequently be required, such as milling or drilling, to obtain recesses and/or openings. In addition, such processes are known to the skilled person and can be applied on a commercial scale. Due to such rotational symmetry, the connection element can be arranged in the terrace canopy independently of the direction and the bearing capacity and strength are also the same in different directions. Typical examples are a corner element with a substantially triangular, square, hexagonal, circular, etc. cross section.

In an embodiment of the present invention, each headboard is provided with at least one bolt opening and the connection element is provided with a corresponding bolt opening, which bolt openings are configured for attaching a headboard to the connection element. Bolt openings and bolts (this also includes screw holes and screws) are a simple way of connecting two elements together.

The object of the invention is also achieved with a method for producing a terrace canopy as described above, the method comprising: providing the beam, the support column, the headboards and the connection element, wherein the provision preferably comprises: extruding the beam and/or extruding the support column and/or casting the headboards and/or extruding the connection element; producing the recess in the beam, preferably by milling away a portion of the beam; attaching the headboards onto the third and fourth ends; placing the support column on a ground surface; securing the connection element onto the support column; placing the beam on the support column; and securing the headboards to the connection element.

The method results in the terrace canopy described above and hence has the same advantages already described. In addition, all production techniques used are known to the skilled person and can be applied on a commercial scale.

BRIEF DESCRIPTION OF THE DRAWINGS

The invention will be explained in further detail below with reference to the following description and the accompanying drawings.

EMBODIMENTS OF THE INVENTION

Figure 1:
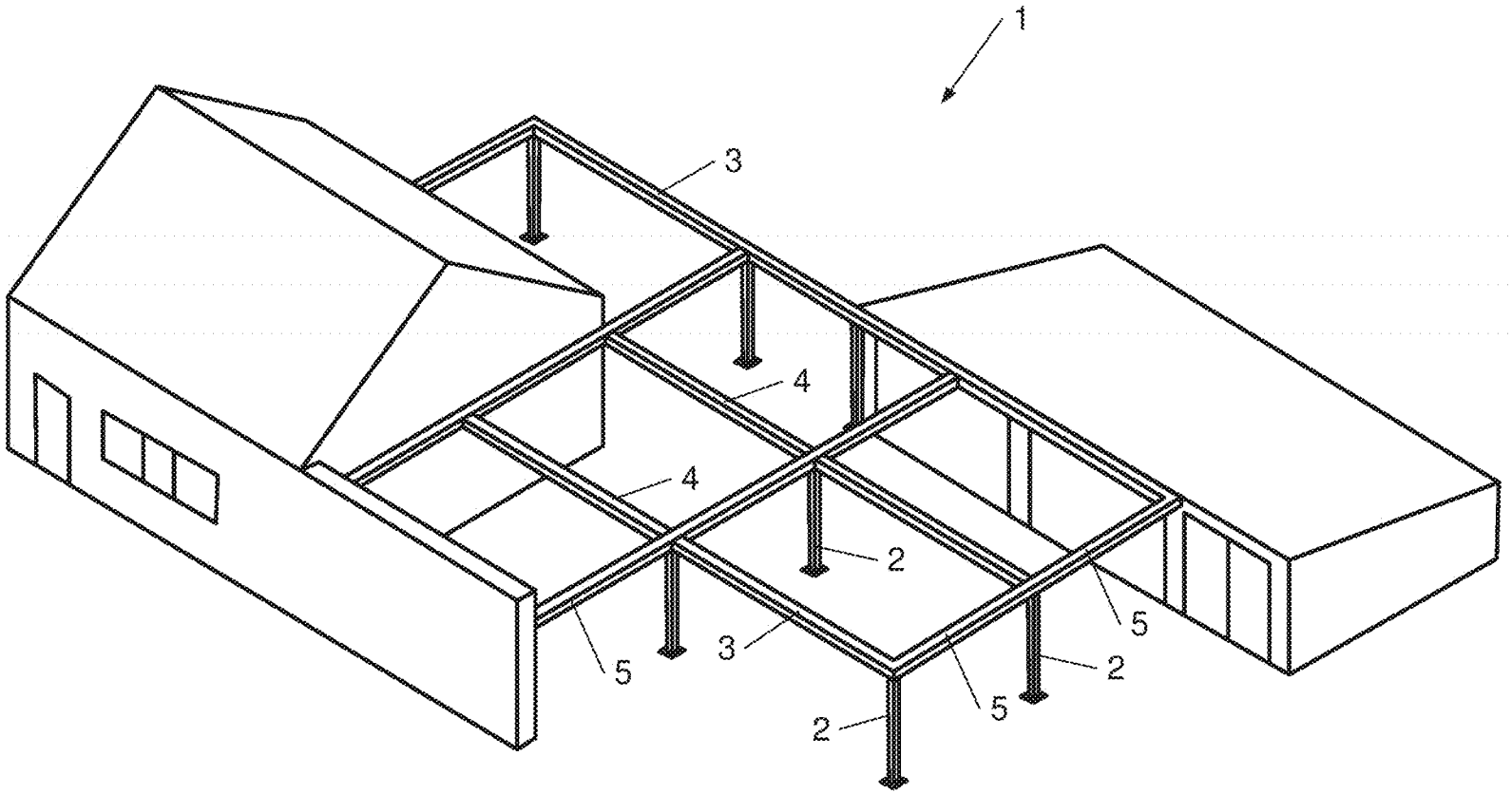
FIG. 1 shows a schematic view of a terrace canopy according to the invention.

The present invention will hereinafter be described with reference to particular embodiments and with reference to certain drawings, but the invention is not limited thereto and is defined only by the claims. The drawings shown herein are only schematic representations and are not limiting. In the drawings, the dimensions of certain parts may be enlarged, meaning that the parts in question are not shown to scale, for illustrative purposes only. The dimensions and relative dimensions do not necessarily correspond to actual practical embodiments of the invention.

In addition, terms such as "first", "second", "third", and the like are used in the description and in the claims to distinguish between similar elements and not necessarily to indicate a sequential or chronological order. The terms in question are interchangeable in appropriate circumstances, and the embodiments of the invention may operate in orders other than those described or illustrated herein.

The term "comprising" and derivative terms, as used in the claims, should or should not be construed as being limited to the means set forth in each case thereafter; the term does not exclude other elements or steps. The term shall be interpreted as a specification of the stated properties, integers, steps, or components referred to, without however excluding the presence or addition of one or more additional properties, integers, steps, or components, or groups thereof. The scope of an expression such as "a device comprising the means A and B" is therefore not limited only to devices consisting purely of components A and B. What is meant, on the contrary, is that, for the purposes of the present invention, the only relevant components are A and B.

With regard to the figures, any reference to an orientation of the beams will be interpreted with reference to the position when mounted in the terrace canopy. In this way, there are four orientations, namely above, below, outside and inside. Here, "above" refers to the portion of the beam that is or will be oriented towards the top surface (the sky, e.g. the open air), "below" refers to the portion of the beam that is or will be oriented towards the ground plane (the earth, e.g. the terrace floor), "outside" to the portion of the beam that is or will be oriented away from the roof, i.e. away from the roof infill and "inside" to the portion of the beam that is or will be oriented towards the inside of the roof, i.e. facing the roof infill.

The term "substantially" includes variations of +/−10% or less, preferably +/−5% or less, more preferably +/−1% or less, and more preferably +/−0.1% or less, of the specified condition, in as far as the variations are applicable to function in the disclosed invention. It is to be understood that the term "substantially A" is intended to also include "A".

FIG. 1 illustrates a terrace canopy 1 for a ground surface, for example a terrace or garden. The terrace canopy comprises a plurality of columns 2 supporting different beams 3, 4, 5. The columns and beams together form frames to which wall infills 6 and/or roof coverings 7 can be attached, as described hereafter. The canopy 1 comprises three types of beams 3, 4, 5, namely: a beam 3 serving on the outside of the canopy 1 as an external pivot beam 3; a beam 4 serving centrally in the roof 1 as a central pivot beam 4; and a beam 5 serving as tension beam 5. It will also be appreciated that the beams 3, 4, 5 can be attached to other structures, for example a wall or facade, instead of solely lying on columns 2 as shown in FIG. 1. In such a way the terrace canopy 1 can be used in general for shielding an outdoor space, as well as an indoor space.

Figure 2:
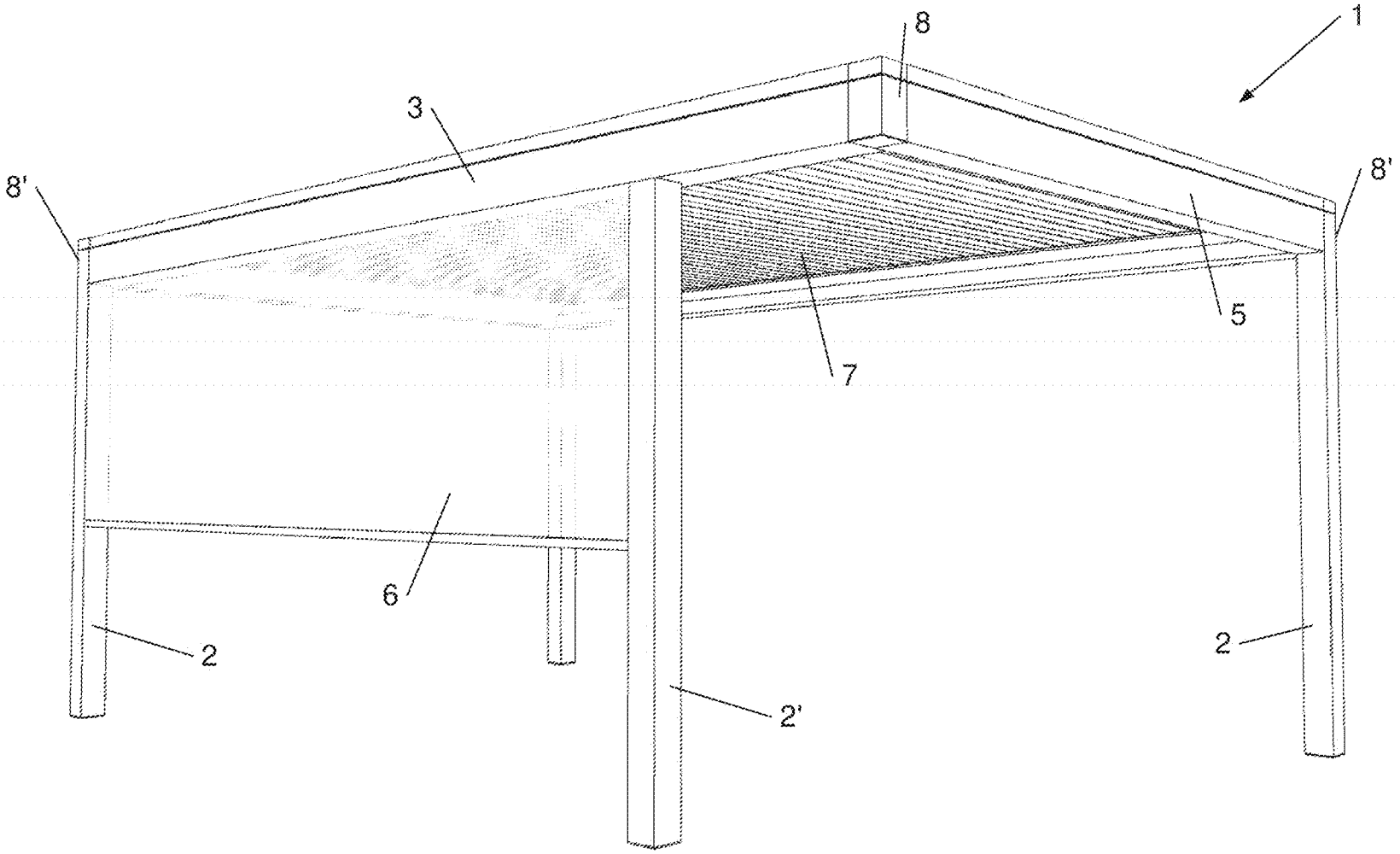
FIG. 2 shows an embodiment of the terrace canopy with a wall infill.

FIG. 2 shows a terrace canopy 1 according to the present invention with a wall infill 6. The terrace canopy 1 has four support columns 2, 2' which support a frame, also called a roof frame. The frame is formed from two external pivot beams 3 and two tension beams 5 between which a roof covering 7 is provided. According to the present invention, the roof frame is not supported in at least one corner, in this case in corner 8 because column 2' is shifted with respect to this corner 8. It will be readily appreciated that the other corners 8' also do not need to be supported by a column, but that each of these columns may also be shifted relative to the respective angle of the roof frame.

In the embodiment shown, the roof covering 7 is formed by slats which are rotatably attached at their front ends to pivot beams 3. The slats are rotatable between an open position and a closed position. In the open position, there is an intermediate space between the slats through which, for example, air can be introduced into the underlying space or can leave this underlying space. In the closed position, the slats form a closed roof with which the underlying space can be shielded from, for example, wind and/or precipitation, such as rain, hail or snow. With regards to the discharge of precipitation, the slats are typically inclined towards one of the two pivot beams 3. In an embodiment, additionally the slats can, in their open position, optionally be slidably provided in the terrace canopy 1, in order to further increase the control options in terms of light incidence, radiant heat and ventilation.

The slats are typically manufactured from a rigid material. This can be aluminium, for example. Aluminium has many advantages as a material because it is robust and light at the same time, resistant to adverse weather conditions and requires little maintenance. However, other materials are also suitable and their advantages or disadvantages are believed to be known to the skilled person. A slat can be produced using different techniques depending on the material, including extrusion, milling, setting, casting, welding, and so on. The appropriate producing technique is believed to be known to the skilled person. Preferably, the slats are manufactured by means of an extrusion process. Optionally, filling elements of, for example, polycarbonate, glass, wood, etc. can be used to at least partially fill the hollow slats, for example to obtain another appearance of the slat.

More generally, the roof covering 7 is arranged stationary or movably. A movable roof covering comprises, for example, tiltable and/or slidable slats (as described above) and/or roll-in and roll-out screens and/or slidable panels. In their closed position, the individual elements of the movable roof covering 7 form a substantially watertight roof with which the underlying space can be shielded from, for example, wind and/or precipitation, such as rain, hail or snow. This roof covering 7 is typically drained to the pivot beams 3, 4 and from there directly or via the tension beams 5 to the columns 2. By shifting and/or rotating the slats and/or the panels and/or by rolling up a screen, the roof covering 7 can be opened and/or closed at least partially in order to be able to determine the incidence of light, radiant heat, ventilation, precipitation, etc. to the space under the roof covering 7 as desired.

Wall infills 6 are typically intended to shield openings under the terrace canopy 1 between the columns 2. The wall infills 6 can be arranged stationary or movably. Movable side walls comprise, for example, roll-in and roll-out screens and/or wall elements that are slidably arranged relative to each other, etc. Stationary arranged side walls can be manufactured from different materials, such as plastic, glass, metal, textile, wood, etc. Combinations of different wall infills 6 are also possible. FIG. 2 illustrates a wall infill in the form of a roll-in and roll-out screen 6. The screen 6 extends between two adjacent columns 2 and can be rolled out from the external pivot beam 3. The screen 6 mainly serves as a wind and/or sun screen.

In general, the beams 3, 4, 5 are constructed from one or more profiles as described hereafter. The profiles are typically made of a rigid material. This can be aluminium, for example. Aluminium has many advantages as a profile material because it is robust and light at the same time, resistant to adverse weather conditions and requires little maintenance. However, other materials are also suitable and their advantages or disadvantages are believed to be known to the skilled person. A profile can be produced using different techniques depending on the material, including extrusion, milling, setting, casting, welding, etc., with extrusion being the preferred choice. The appropriate producing technique is believed to be known to the skilled person.

Figure 9:
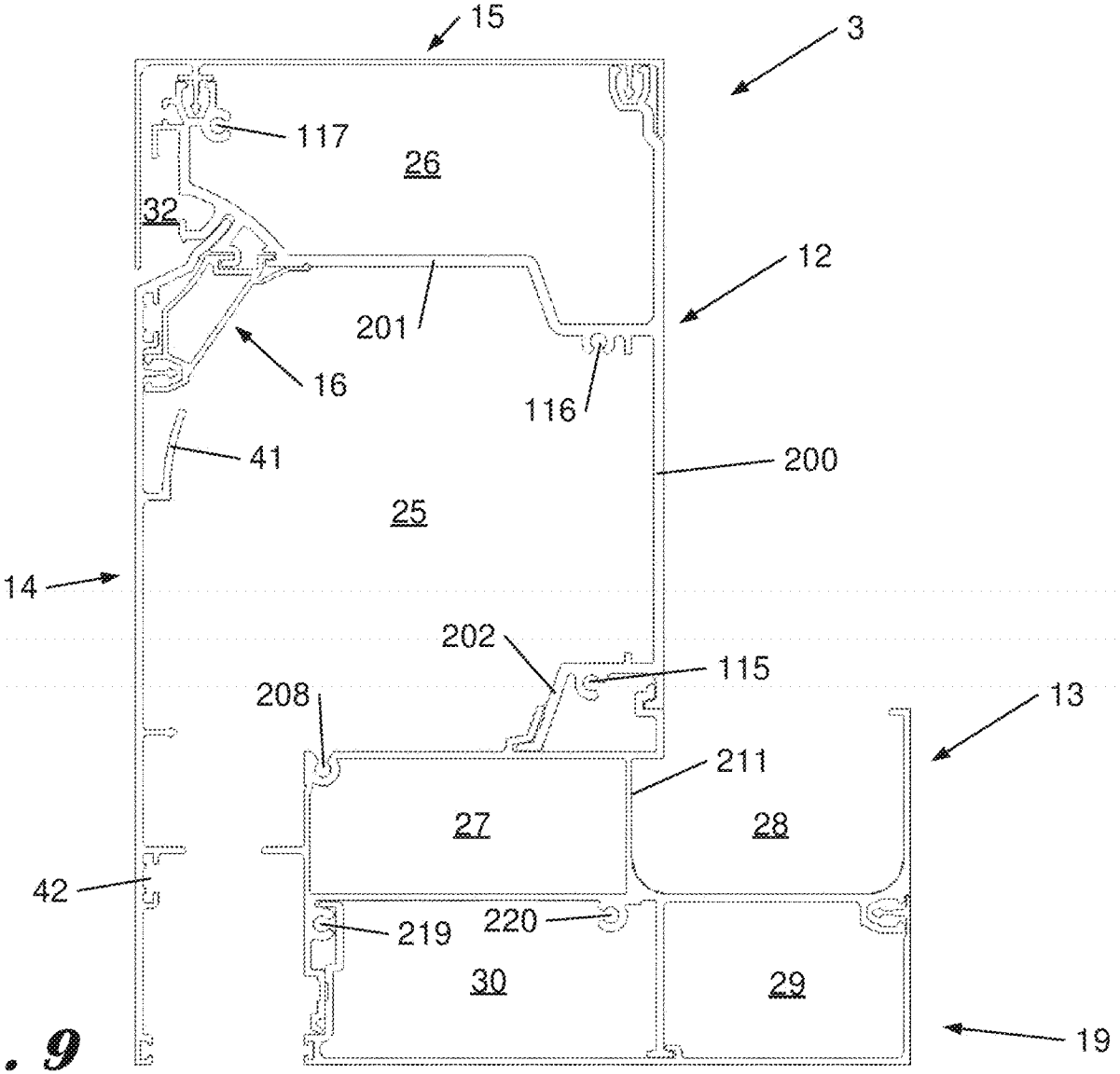
FIG. 9 shows a section through the external pivot beam of the terrace canopy of FIG. 2.

In general, the beams 3, 4, 5 of the terrace canopy 1 are hollow, as shown in FIG. 9. The beams 3, 4, 5 are composed of a plurality of profiles. For a detailed description of the possible assemblies of the beams 3, 4, 5, reference is made to PCT/IB2021/053275, in particular FIGS. 3A through 7 therein, which description and figures are thus incorporated herein by reference. Hereinafter, the beams 3, 4, 5 are only briefly described with reference to FIG. 9 (which is identical in design to FIG. 3B of PCT/IB2021/053275).

To form the beams 3, 4, 5, a plurality of profiles are connected to each other in a specific way. Generally, pin connections and/or hook connections are used. In a pin connection, typically an elastic element is present in a female element, for example a slot element, into which a male element, for example a pin, engages. Hence, a pin connection generally comprises an elastically engaging male and female element. For this purpose, an additional elastic element may be provided, but this is not necessarily the case. The elasticity can also arise from the shaping of the male and female elements. Hook connections typically involve two elements with a design such that they hook into each other. This does not involve an elastic element and the connection is taken apart by moving the elements away from each other in the correct direction.

In addition, in general, for each connection of two profiles to each other, use is made of two separate connections. This promotes the strength of the connection, but mainly contributes to the correct mutual positioning of the profiles. This is because, if only one connection is used for two profiles, there is more clearance in the mutual positioning, which can give rise to a deviating positioning, in particular due to wind loads and/or precipitation loads.

FIG. 9 shows a cross-section through the external pivot beam 3 of the terrace canopy of FIG. 2. The external pivot beam 3 is intended to be placed on the outside of the terrace canopy 1 and must provide for water drainage from precipitation incident on the terrace canopy. In particular, this precipitation can be collected, for example, by a slatted roof 7 that drains precipitation to this pivot beam 3. The roof infill 7 drains the precipitation to the pivot beam 3 where it is collected in the external gutter 28. Between the external gutter 28 and the cavity 27, the partition wall 211 is present, which is provided with one or more openings, for example a series of perforations, such that the precipitation from the external gutter 28 is diverted to the cavity 27. That is why the bottom of the external gutter 28 also preferably slopes towards the cavity 27. The cavity 27 serves as an internal gutter for the passage of precipitation from one or more connecting pivot beams 3 to a column 2, along which this precipitation can leave the terrace canopy 1, as described hereafter.

The pivot beam 3 is constructed from a number of profiles, namely a base profile 12, a double gutter profile 13, a front cover 14, a cover profile 15, a connecting profile 16 and a closing profile 19. A screen cavity 25 is formed by the base profile 12, the double gutter profile 13 and the front cover 14 (i.e. a finishing profile). The screen cavity 25 is intended for housing a roll-in and roll-out screen 6 that serves as side wall of the terrace canopy 1, as shown in FIG. 2. The cover profile 15 serves to close off a technical space 26 in the external pivot beam 3. This technical space 26 can serve to house drive means for tilting slats of the roof covering 7 and/or cabling for, for example, lighting, etc. The front cover 14 and the cover profile 15 are both removable. As a result, the screen cavity 25 and the technical space 26 are accessible such that adjustments, modifications and/or repairs can be made, if necessary.

The front cover 14 typically forms the outside of the external pivot beam 3 and is attached to the base profile 12 through a connecting profile 16. In the embodiments shown, the front cover 14 is further provided with a reinforcing rib 41 and a slot 42. The reinforcing rib 41 contributes to the rigidity of the front cover 14 and is useful for obtaining the required resistance at higher loads, especially when bridging relatively long lengths. The slot 42 is provided for arranging therein a holder (not shown) which serves as an abutment for the screen 6 when it is being rolled up. Alternatively, the slot 42 or another wall may serve as such screen roll abutment. The pivot beam 3 also comprises a space 32 between the cover profile 15 and a part of the base profile 12. The double gutter profile 13 is also provided with spaces 29, 30 which are closed by means of the substantially U-shaped closing profile 19.

Furthermore, the external pivot beam 3 is provided with fastening channels 115, 116, 117, 208, 219, 220 for screwing a headboard to one end of this beam 3 by means of screws or bolts, for the purpose of connecting the beam to a column of the terrace canopy 1. Fastening channel 115 is provided on the bottom side of the base profile 12; fastening channel 116 is provided centrally in the base profile 12 in the screen cavity 25; fastening channel 117 is provided at the top side of the base profile 12 in the technical room 26; fastening channel 208 is provided at the upper outer corner of the inner gutter 27; and the fastening channels 219, 220 are provided under the inner gutter 27 on either side thereof. Of course, more or fewer fastening channels are also possible and/or their positioning may be different.

The terrace canopy 1 of FIG. 2 also comprises two tension beams 5. A cross-section thereof is not shown as it is quite similar to that of the pivot beam 3, with the main difference being the absence of an external gutter 28. In the tension beam 5 fastening channels are also provided for screwing a headboard to an end of this beam 5 by means of screws or bolts for the purpose of connecting the beam to a column of the terrace canopy 1. Preferably, the fastening channels of the tension beam 5 have the same positioning as with the pivot bar 3.

Figure 10:
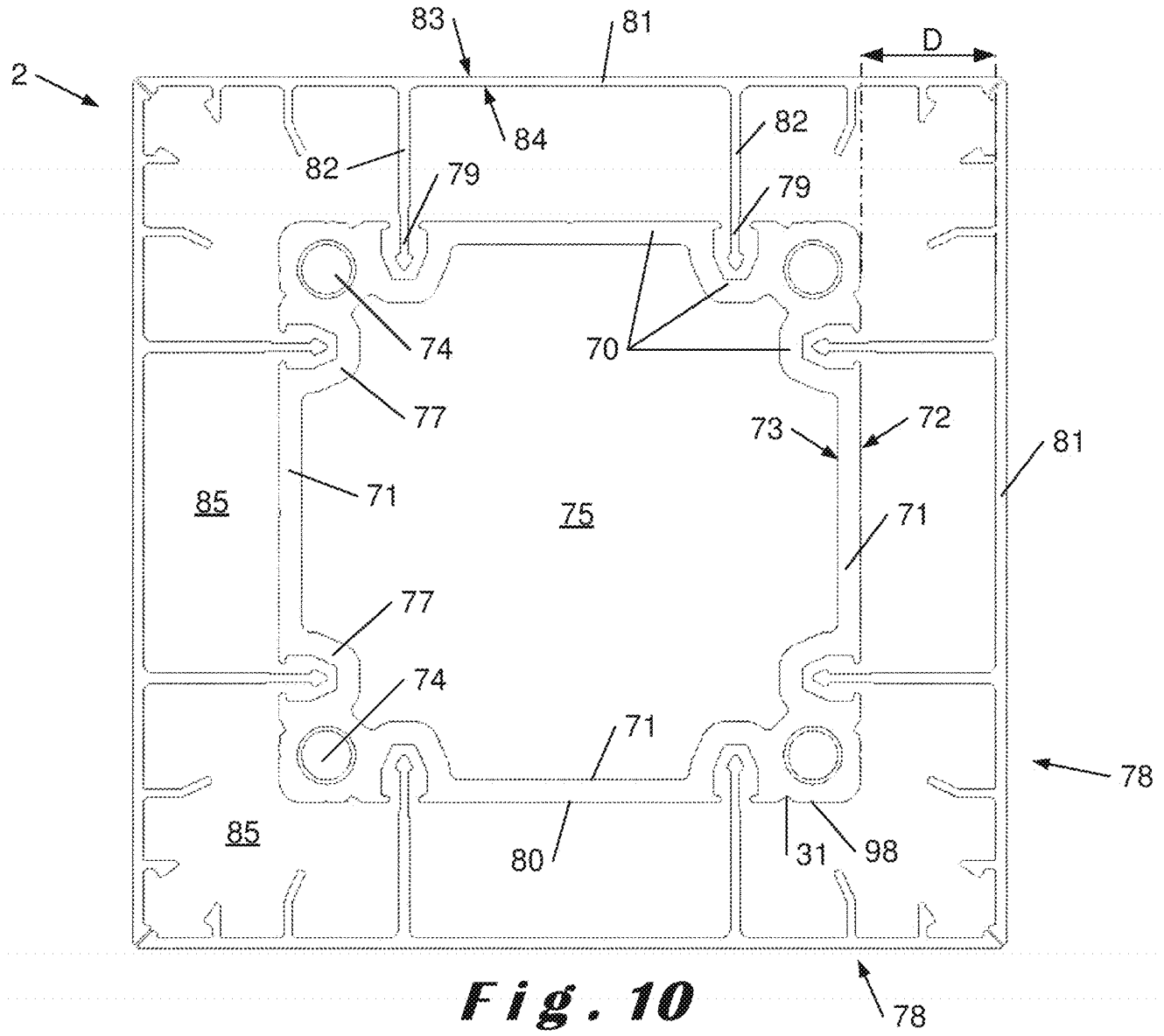
FIG. 10 shows a section through the column of the terrace canopy of FIG. 2.

In general, the column 2 of the terrace canopy 1 is hollow, as shown in FIG. 10. The column 2 is composed of a core part 70 onto which several different finishing profiles 78. For a detailed description of the possible assemblies of the column 2, reference is made to PCT/IB2021/053271, in particular FIGS. 3A through 31 therein, which description and figures are thus incorporated herein by reference. Hereinafter, the column is only briefly described with reference to FIG. 10 (which is identical in shape to FIG. 3A of PCT/IB2021/053271).

A cross-section through a column 2 of the terrace canopy 1 is shown in FIG. 10. The column 2 comprises an integrally formed core part (generally denoted by reference numeral 70). In particular, the core part 70 is formed by a profile of the same or similar type as the profiles of the beams 3, 4, 5. The profile 70 is preferably extruded from aluminium. The profile 70 serves as a support column for the terrace canopy 1. In particular, substantially the entire weight of the beams 3, 4, 5 and the elements connected thereto, such as the side walls 6 or the roof covering 7, is supported by the support column 70.

The core profile 70 has a substantially square shape in the embodiments shown. Hence, each core profile 70 has four side walls 71, each with an outer side 72 and an inner side 73. Each outer side 73 is provided with two mounting means 77, in particular mounting slots, preferably female pin connection means. These slots 77 serve for the attachment of finishing profiles 78 by means of a corresponding connection means 79, preferably a pin. It will be readily appreciated that the pin connection 79 is only one example of a way of attaching the finishing profiles 78 to the core profile 70 and that other ways are known to the person skilled in the art. It will also be readily appreciated that the slots 77 need not necessarily be continuous, although this is preferred since the core portion 70 is preferably manufactured by an extrusion process. Preferably, the slots 77 are positioned symmetrically with respect to the centre of a side wall 71, such that the attachment points of a finishing profile 78 to the side wall 71 are also symmetrical, which is advantageous.

Although the use of two mounting means 77 per side wall 71 is preferred, in view of the use of two separate fastenings between two profiles, less clearance is allowed in the mutual positioning, which clearance can lead to a different positioning, in particular due to wind loads and/or precipitation loads, is a connection with only one application means per side wall also possible. On the other hand, more than two application means per side wall can also be provided.

It will be readily appreciated that the core profile 70 as described above is not limited to a substantially square shape. Also, the four side walls 71 can be arranged in a different geometric shape, for example a rectangle or parallelogram. In addition, it is also possible to provide more or fewer side walls 71 per core profile 70, in particular triangular, hexagonal or octagonal core profiles 70 are also possible. Furthermore, the core profile 70 may also be ellipsoidal, in particular circular, with the desired number of mounting slots then provided in the one continuous sidewall comprising the core profile 70.

The column 2 is further provided with four finishing profiles 78, namely one on each side wall 71. Each finishing profile 78 is provided with a flat outer wall 81, the outer side 83 of which determines the visual appearance of the column 2. In other words, the finishing profile 78 hides the core profile 70 in the mounted terrace canopy 1. Furthermore, each finishing profile 78 is provided with pins 79, namely one pin per mounting slot 77. The pins 79 are connected to the outer wall 81 by means of walls 82 which serve as spacers. In particular, the length of the walls 82 determines the distance D between the outer side 72 of a wall 71 and the inner side 84 of the outer wall 81. Cavities 85 are also created by providing spacers 82. One or more of these cavities 85 can be used for integrating electrical lines that serve to drive the wall infill 6, the roof infill 7 and/or other electrically driven components.

The present invention relates to a terrace canopy 1 wherein, for at least one beam 3, 5 of the roof frame, the supporting column 2 is shifted relative to the end of the beam 3, 5. The present invention will be described with reference to FIGS. 3A to 7 with a tension beam 5 as beam. The situation with an external pivot beam 3 as beam is briefly described with reference to FIG. 8.

Figure 3A:
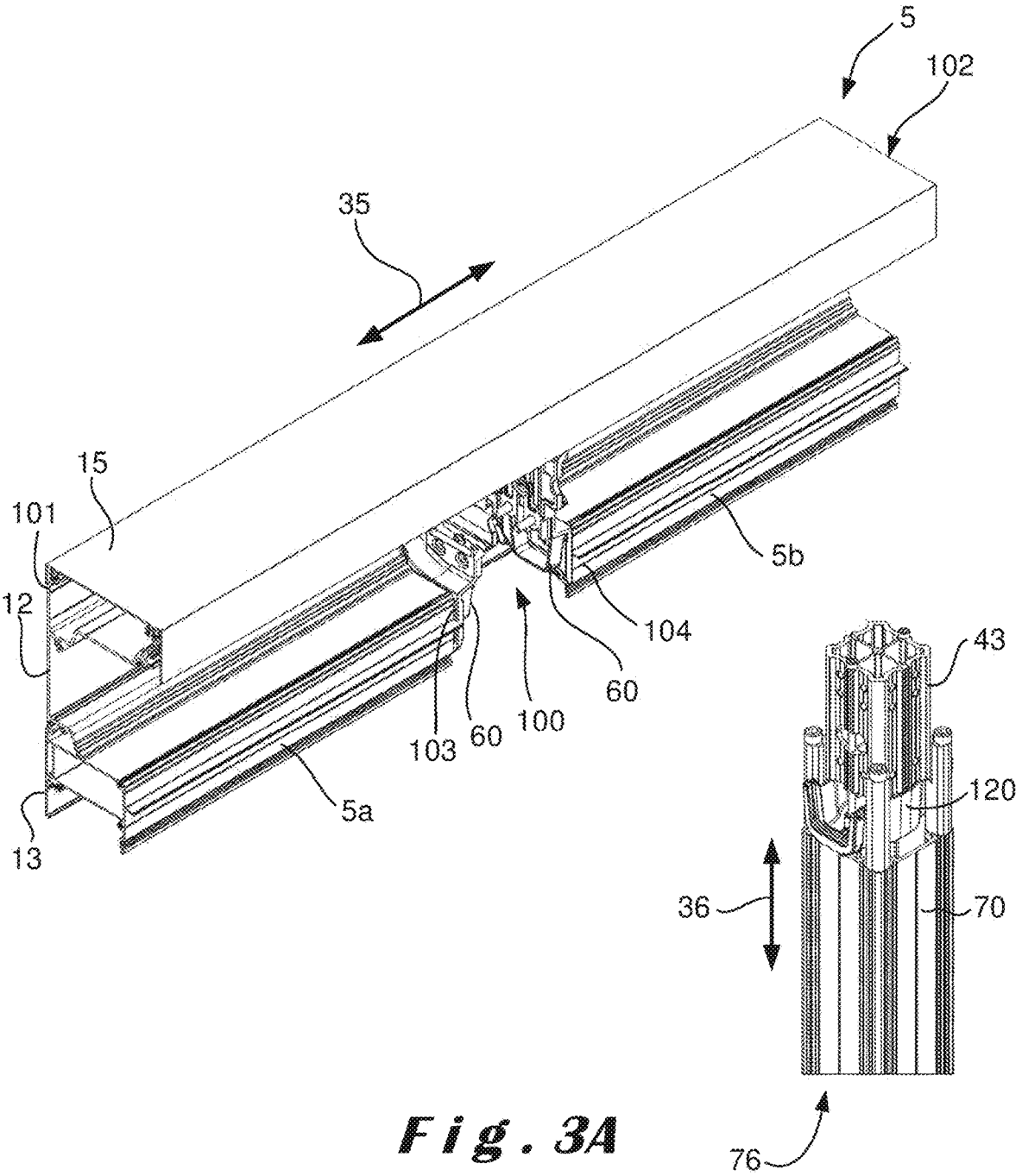
FIGS. 3A and 3B show a perspective view of a tension beam with a shifted column in partly exploded view from the top side and bottom side, respectively.

FIG. 3A illustrates a beam 5 which extends in a longitudinal direction, which longitudinal direction 35, in the assembled state of the terrace canopy 1, corresponds to a substantially horizontal direction between a first end 101 and a second end 102. In the beam 5 a recess 100 is arranged, which recess 100 divides the beam 5 into a first beam portion 5*a* and a second beam portion 5*b*. The first beam portion 5*a* extends between the first end 101 and a third end 103 and the second beam portion 5*b* extends between the second end 102 and a fourth end 104. In one embodiment, the recess 100 is formed by removing material from the beam 5, for example by milling.

A headboard 60 is attached on the third and fourth ends 103, 104. The headboard 60 is shown in more detail in FIG. 7. Five openings 62 are provided in the headboard, which correspond in positioning to the fastening channels 115, 116, 208, 219, 220. This allows to attach the headboard 60 to the beam portions 5*a*, 5*b* by means of five bolts or screws 61 (shown in FIGS. 5A and 5B) protruding through openings 62. It will be readily appreciated that more or less openings and fastening channels can be used, if desired. Although it is also possible to provide the fastening channels in the headboard and to screw the bolts from the beams onto the headboard, the embodiment shown is preferred. This is because the headboard can be made more compact, in particular thinner, if no long fastening channels are to be present.

In the embodiment shown, the beams 3, 5 are provided with fastening channels 115, 116, 117, 208, 219, 220 which are provided in the same place for each beam. In this way, one and the same headboard 60 can be connected to any embodiment of external pivot beam 3 and tension beam 5. Alternatively, it is of course also possible to provide different headboards 60 for different beams 3, 4, 5 if the positioning of the fastening channels varies. It is also possible to vary, within the same beam, the placement of the fastening channels 115, 116, 117, 208, 219, 220 between the beam portions.

Figure 7:
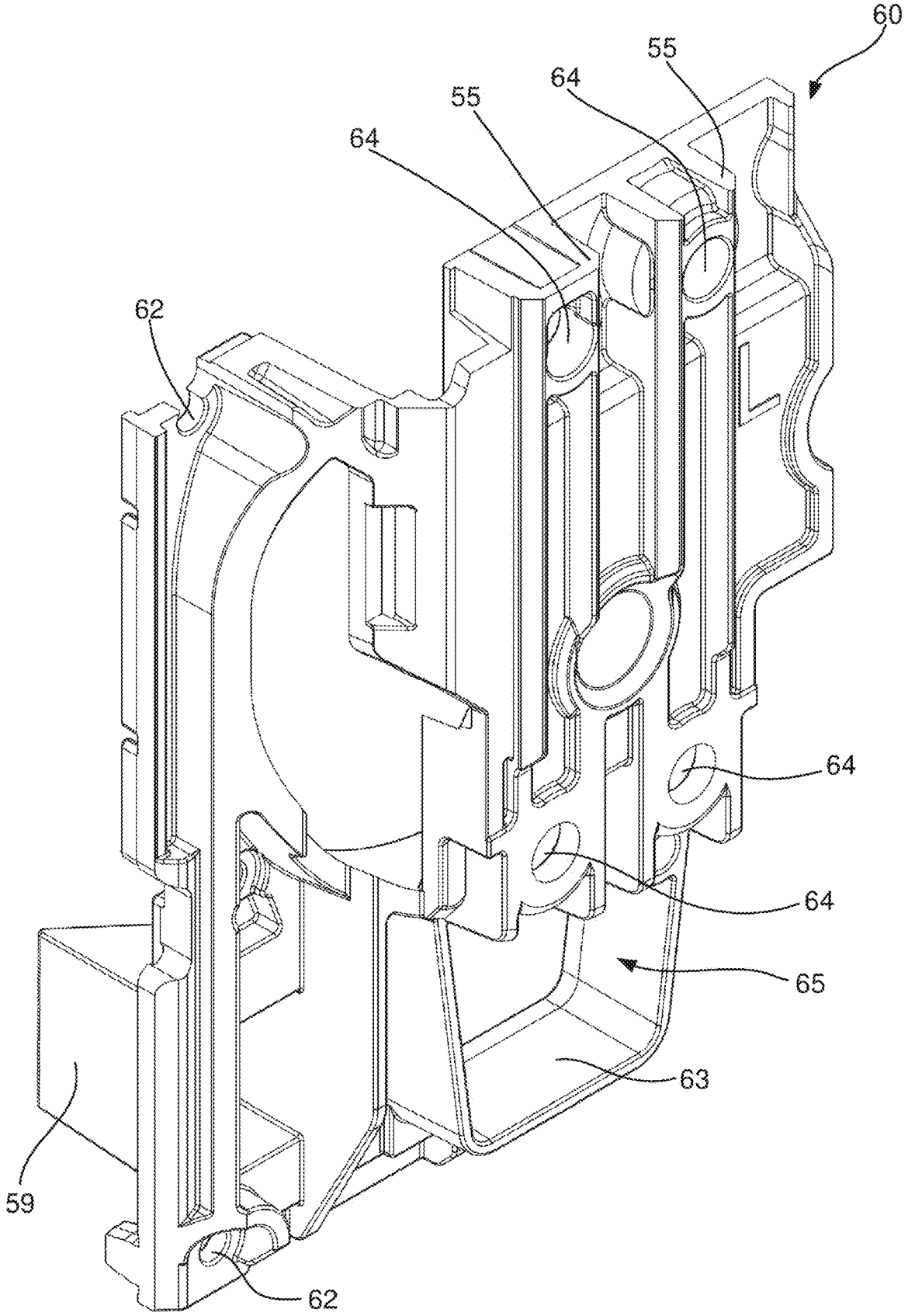
FIG. 7 shows a perspective view of an embodiment of a headboard.

As shown in FIG. 7, the headboard 60 is provided at its rear with four openings 64. These form a way of attaching the headboard 60 to the column 2, as described in more detail hereafter.

Figure 5A:
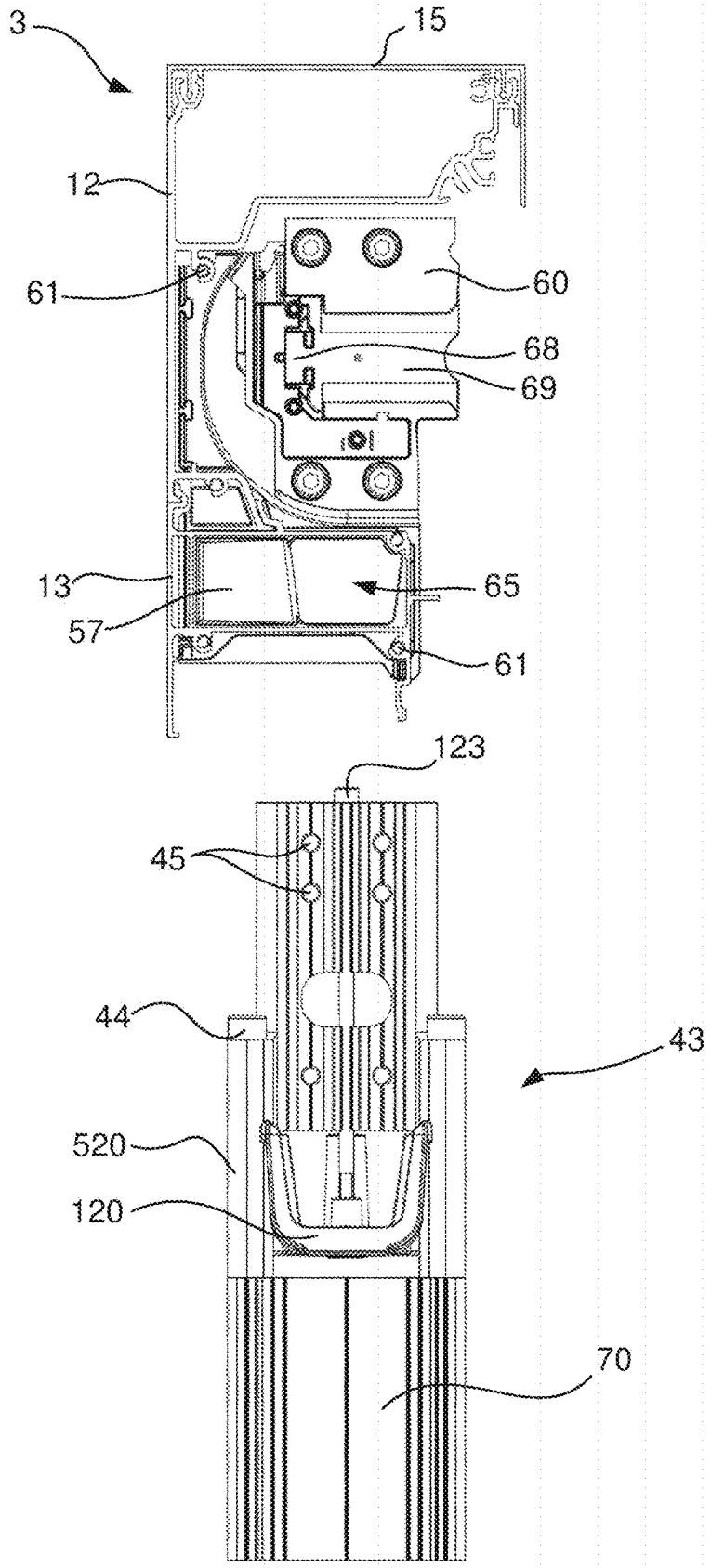
FIGS. 5A and 5B show a side view of a tension beam with a shifted column in partly exploded view and assembled state, respectively.
Figure 5B:
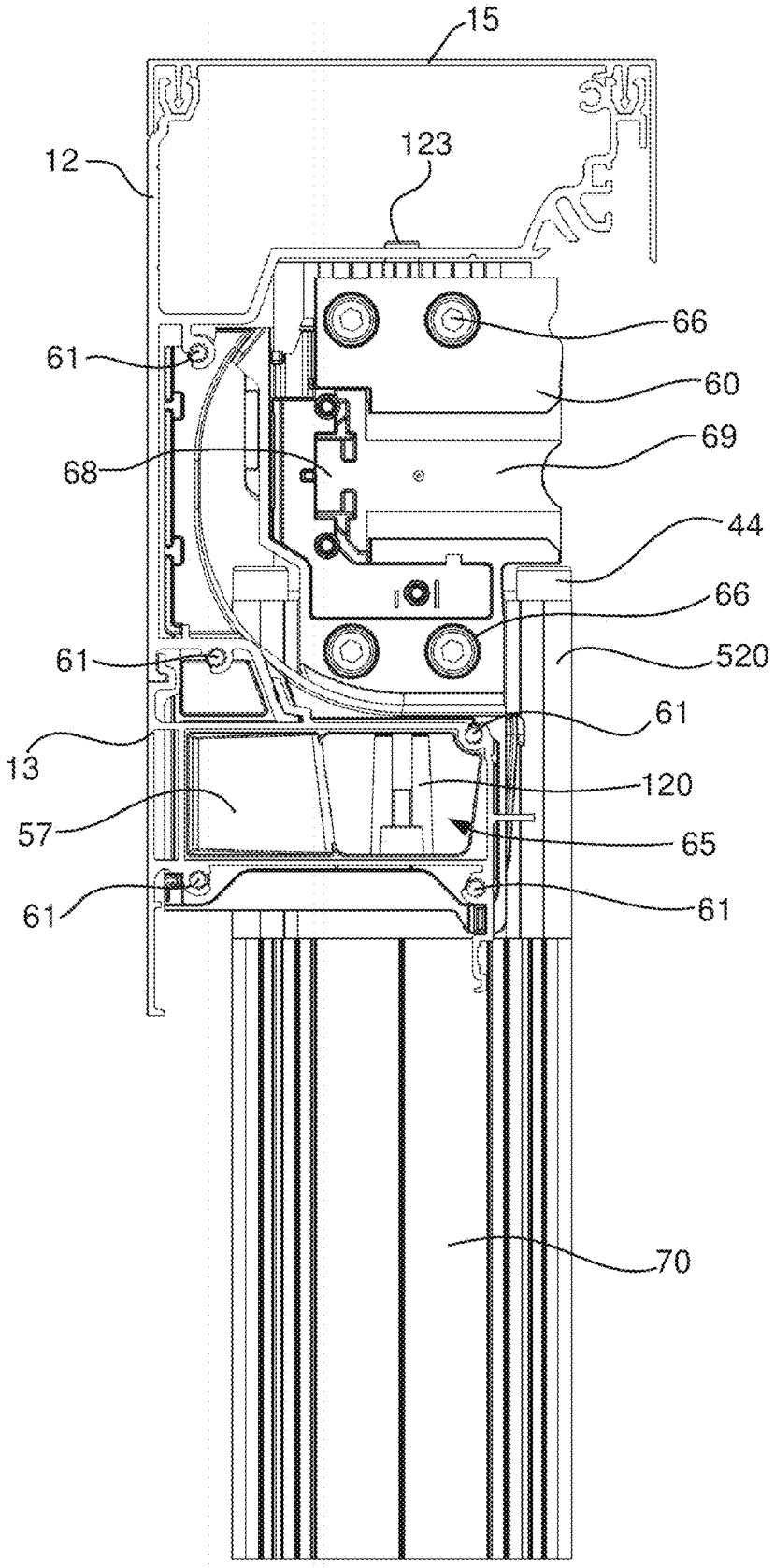

At the bottom side, the headboard 60 is provided with a passage 65 with a spout-shaped part 63, which connects to the central gutter 27 of the beams 3, 5. In this way, precipitation collected in the internal gutter 27 can leave it via passage 65 and spout 63. The external gutter 28 is provided with a closure (not shown) at its front end, such that the precipitation collected in the external gutter 28 cannot but flow to the internal gutter 27. The headboard 60 is also provided on its bottom side with a prismatic abutment 59 which contributes to the alignment of the headboard 60 with the beam 5. In particular, the stop 59 fits in the cavity 27 as shown in FIG. 5B. FIGS. 5A and 5B also illustrate the provision of a number of holders at the front of the headboard 60. In particular, there is an electronics holder 68 in which the necessary electronics can be placed, for example for driving the screen 6. Along the electronics holder 68, a screen holder 69 is present in which one end of the screen roll can be placed.

Figure 6:
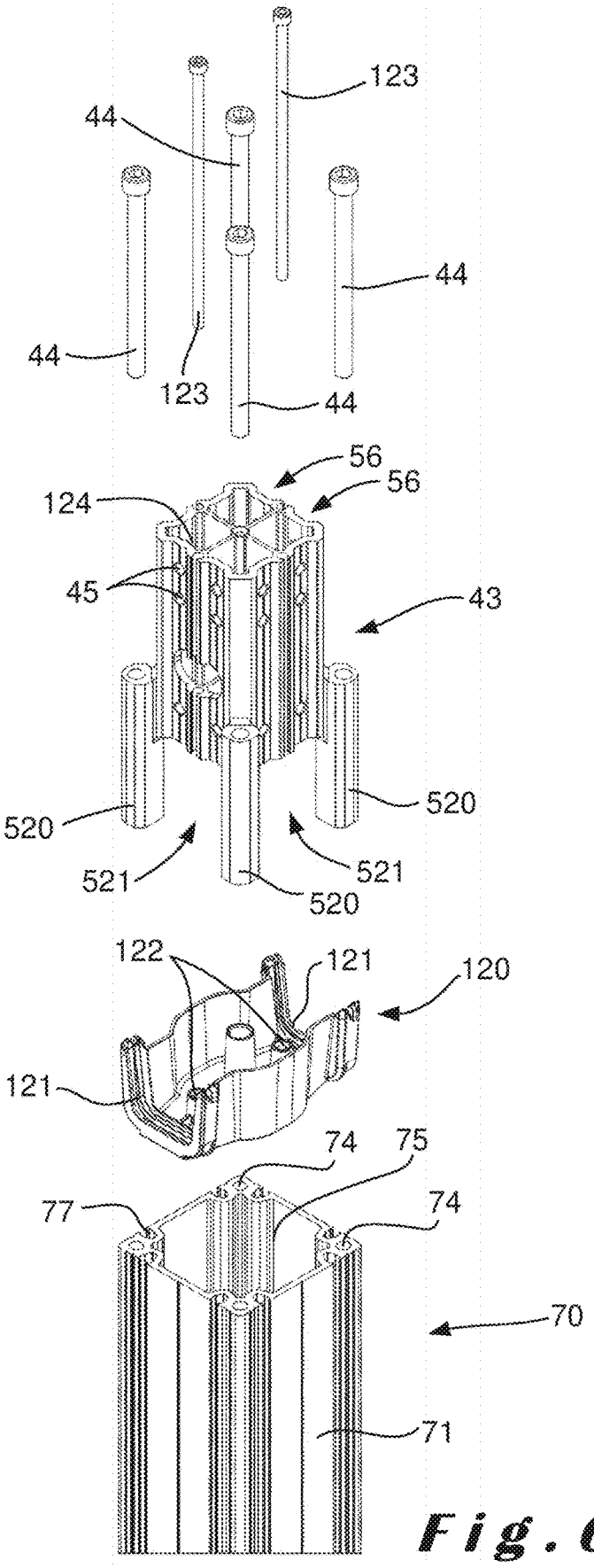
FIG. 6 shows an exploded view of an embodiment of the shifted column.

FIG. 6 illustrates core profile 70 onto which a crown 43 is secured. In particular, the core profile 70 is provided on its top side with four openings 74 which are suitable for receiving bolts or screws 44. Correspondingly, the crown 43 is provided with four legs 520, in particular one leg 520 per corner point of the crown 43. Openings 521 are provided between the legs 520, which serve as a passage for precipitation drainage. In particular, as further described, the spout portion 63 of a headboard 60 fits into the passageway 521. The legs 520 are hollow such that the bolts 44 can be screwed through the legs 520 onto the profile 70 to allow the crown 43 to be attached directly to the profile 70, as shown in FIG. 10. As a result of this attachment, the profile 70 and the crown 43 together form the core 76 of the column 2, as indicated in FIG. 3A; this figure also shows the substantially vertical direction 36 with which the longitudinal direction of the core 76 substantially coincides in the assembled state of the terrace canopy 1. It is this core 76 that serves as a constructive element, in particular as a support for the beams 3, 5. It will be readily appreciated that other connection means are also possible to secure the legs 520 to the top side or the outside of the support column 70, such as the use of an elongated rod and securing it by one or more transverse pins or by welding the parts together. A threaded rod can also be used as a connection means, in which case it is, for example, fixedly provided on the top side of the profile 70 and over which the legs 520 are slid.

The crown 43 serves for attaching the beams 3, 5 to the column 2. To this end, the crown 43 is provided with openings 45 into which bolts (or screws) 66 (shown in FIG. 3B) are screwed to secure the headboard 60 with the crown 43. In this way, the headboards 60 together with the crown 43 actually form a connection between the beams 3, 5 and the support column 70, i.e. the crown 43 forms a connection element. Although this connection could be made integrally, i.e. one integral element that combines the functionality of the headboards and the crown, it is preferable to make a division between the crown 43 and the headboards 60. Firstly, this allows to design of the headboards 60 as a function of the beam 3, 5 and yet make use of only one crown 43. Furthermore, such an integrated corner connection is difficult to place in the recess 100 and to secure it to the beam portions 5*a*, 5*b*.

The main advantage of the structure of column 2 is that the forces by the beam portions 5*a*, 5*b*, for example due to their weight or due to wind load on a side wall that is attached to the beam portions 5*a*, 5*b*, are transferred directly to the core 76, in particular to the crown 43 thereof. In other words, although the headboards 60 are located between the beam parts 5*a*, 5*b* and the crown 43, they do not serve as a support element to directly transfer the forces to the support column 70 which forms the bottom side of the column 2.

The headboard 60 is also provided on its side facing the crown 43 with projection ribs 55 which fit into corresponding grooves 56 in the walls of the crown 43. These ribs 55 and grooves 56 form mutually cooperating alignment means for the correct positioning of the headboard 60 on the connection element 43. Such mutually cooperating alignment means between a headboard 60 and a crown 43 have already been described in BE2021/5460, in particular FIGS. 6A to 8B therein, which description and figures are thus incorporated herein by reference.

FIG. 6 also illustrates a passage element 120 which serves to pass collected precipitation between the beam portions 5*a*, 5*b* via the internal gutter 27. The passage element 120 comprises two spout parts 121 which are opposite each other and fit in passages 521. The spout 63 of each headboard 60 fits into the spout parts 121. For fixedly positioning of the passage element 120, two fastening channels 122 are provided in which bolts or screws 123 can be placed. These bolts or screws 123 are also be secured in fastening channels 124 provided on the outer wall of the crown 43. In an alternative embodiment, the passage element is provided with an opening to the bottom side which connects to a tube (not shown) in the cavity 75 of the core profile 70 and thus forms a drainage element for collected precipitation. In this way, the supplied precipitate can be diverted to the bottom side of the column 2 where it can leave the column 2 through an opening (not shown). The cavity 75 can also be used to integrate electrical lines. Although the cavity 85 between profile 70 and the finishing profiles 78 is preferably used for this purpose since this is more easily accessible after mounting. Optionally, the downpipe 49 can also be omitted such that precipitation flows through the cavity 75 of the core profile 70.

Figure 4A:
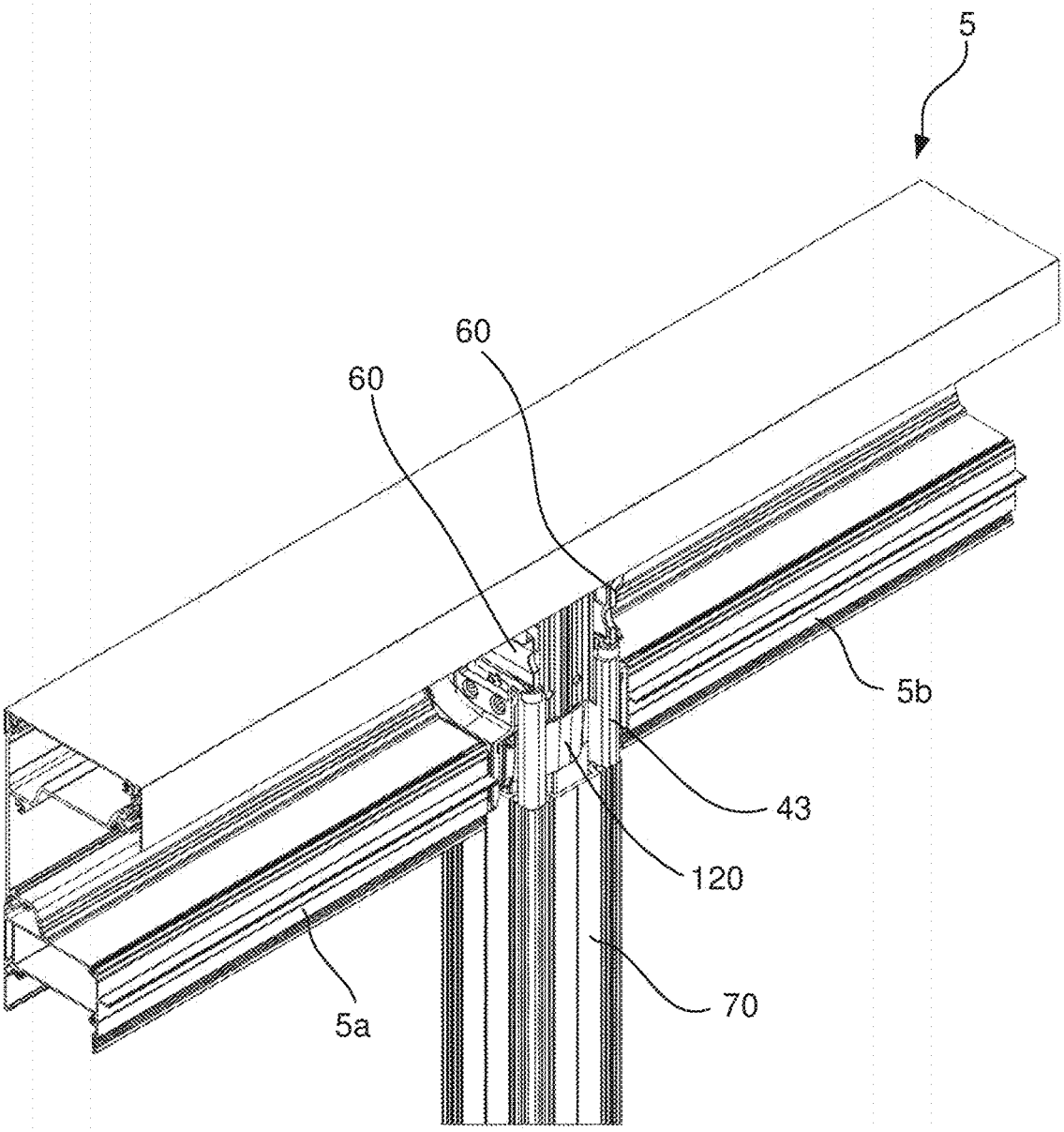
FIGS. 4A and 4B show the same view as FIGS. 3A and 3B in the assembled state of the tension beam and the column.
Figure 4B:
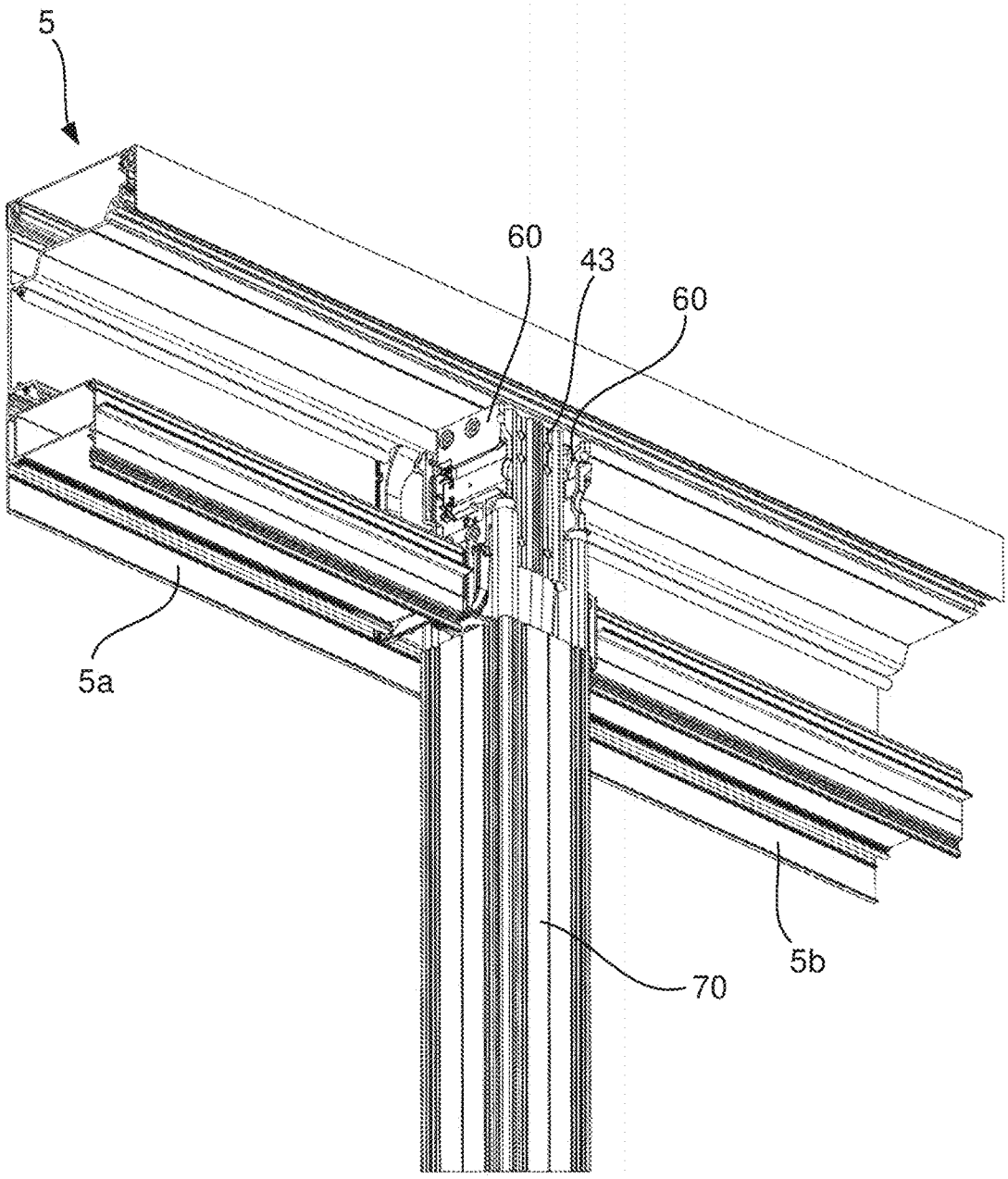

The situation after placing the beam 5 on the core 76 of the column 2 is shown in FIGS. 4A and 4B showing the main structural elements of the final terrace canopy 1. According to the present invention, the beam 5 is connected to the support column 70 via two headboards 60. In particular, each headboard 60 is connected on its one side to an end 103, 104 of a beam portion 5*a*, 5*b* and on its other opposite side to the crown 43 which is secured to the support column 70. In other words, each headboard 60 is actually attached wall-to-wall both against a beam portion 5*a*, 5*b* and against the crown 43. Hence, although the headboards 60 are located between the beam portions 5*a*, 5*b* and the crown 43, they do not serve as a support element to transfer the forces directly to the support column 70, which forms the bottom side of the column 2, in contrast to already known fastening means (for example an L-shaped bracket) which do act as support element.

Figure 3B:
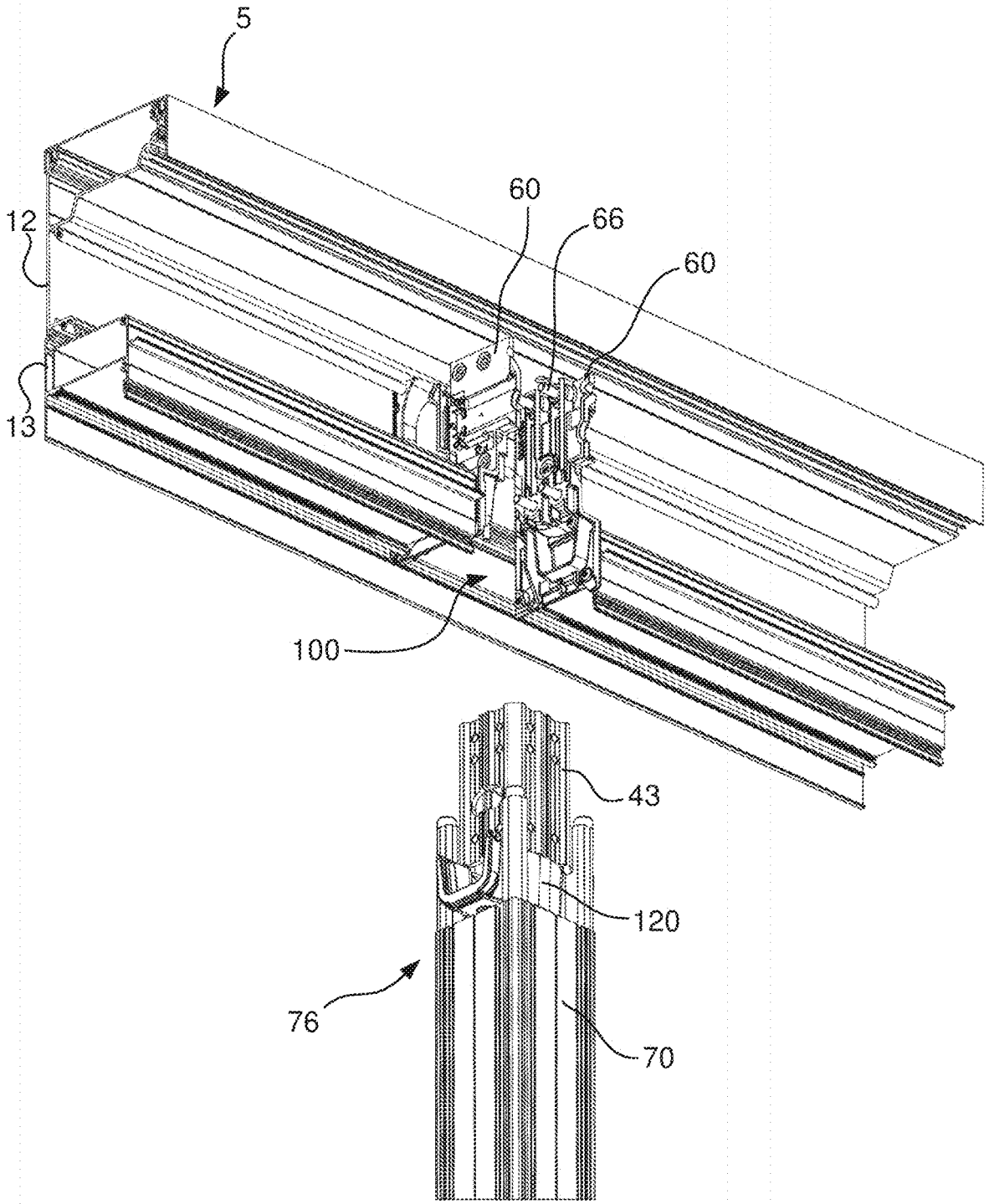

In order to further increase the strength and bearing capacity of the beam 5, a portion of the beam 5 continues uninterrupted (i.e. continuously) over the core 76 of the column 2. This is best shown in FIG. 3B where it is clearly shown that the base profile 12 is only partly removed, in particular the upright wall 200 and the horizontal wall 201 (see FIG. 9) continue uninterrupted. Because these walls together form an L-shaped part, this further increases their strength. In the embodiment shown, only the lower connecting wall 202 of the base profile 12 is partially interrupted. Also, there are certain walls of the gutter profile 13 that continue continuously over the column 2, which further contributes to the general strength of the beam 3, 5.

Figure 8:
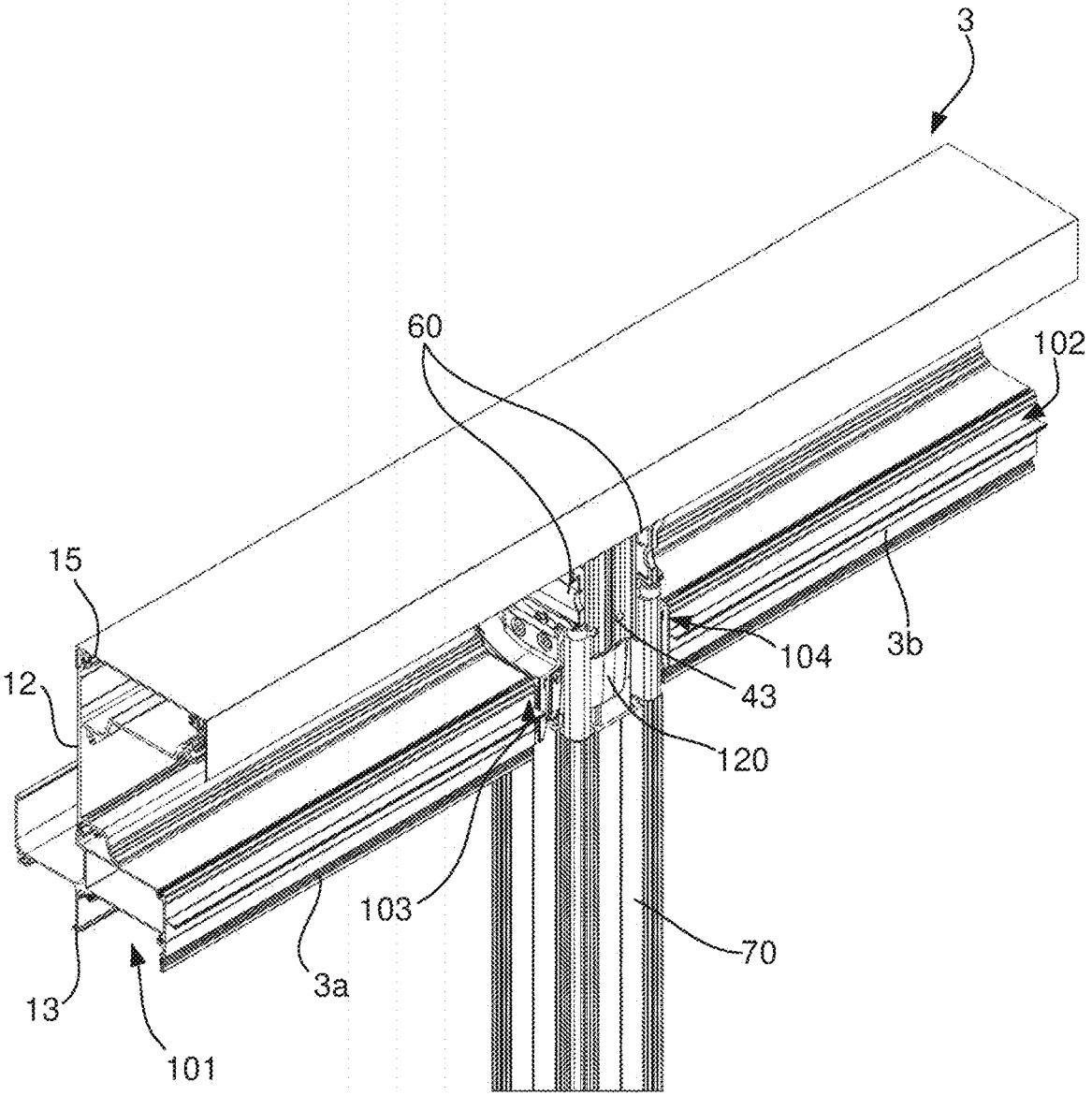
FIG. 8 shows the same view as FIG. 4A but for an external pivot beam.

FIG. 8 shows an example of an external pivot beam 3 supported by a shifted support column 70. The pivot beam 3 is again divided into two beam portions 3*a*, 3*b* by a recess (not shown) into which the crown 43 fits on top of the support column 70. The only difference with the embodiment of FIGS. 3A to 5B is the gutter profile 13 of the beam wherein both an external gutter and an internal gutter is present.

In an embodiment, the terrace canopy 1 is mounted by performing the following steps. In a first phase, the different profiles for the beams 3, 5 and the column 2 are produced typically via an extrusion process. Also at this stage, the crown 43 is extruded and the headboards 60 are manufactured typically via a moulding process. In a next phase, the necessary openings are provided in the extruded profiles and the cast headboards. Also the recess 100 can be arranged therein. Subsequently, the headboards 60 are attached to the beam portions 3*a*, 3*b*, 5*a*, 5*b* and also headboards (not shown) are attached to the other ends of the beam 3, 5. In particular on the base profile 12 and the gutter profile 13. In this phase, the crown 43 is also placed on the support column 70 such that the core 76 of the column is formed. Thereafter, the headboards 60 (with a part of the beams 3, 5 already thereon) are attached to the core 76, in particular to the crown 43. Since the front cover 14 has not yet been placed on the beam 3, 5, it is now possible to place bolts through openings 64 in the headboard 60 for screwing it to the crown 43 through openings 45 therein. In the next phase, the screen roll can be placed in the beams 3, 5 and/or another type of wall infill and/or other internal components such as the roof covering 7. After all internal components have been installed, typically the front cover 14 and/or the cover profile 15 and/or the closing profile 19 are arranged for finishing the beam.

While certain aspects of the present invention have been described with respect to specific embodiments, it is to be understood that these aspects may be implemented in other forms within the scope of protection as defined by the claims.

The invention claimed is:

1. A terrace canopy comprising:

a column;

a beam extending between a first end and a second end, wherein the beam is supported by the column at a location between said ends and wherein the beam, at said location, is provided with a recess, which recess divides the beam into a first and a second beam portion, wherein the first beam portion extends between the first end and a third end and the second beam portion extends between the second end and a fourth end, wherein the recess is located between the third end and the fourth end; and fastening means between the beam and the column for securing the beam to the column, the fastening means comprising:

a first headboard secured onto said third end and onto said column; and a second headboard secured onto said fourth end and onto said column, wherein the beam comprises a continuous profile, and wherein a part of the continuous profile is uninterrupted over an entire length of the beam.

2. The terrace canopy according to claim 1, wherein the first beam portion and the second beam portion are each provided with a plurality of fastening channels each extending in a longitudinal direction of the beam, wherein the first headboard is attached to the third end by a plurality of fastening means which extend through the first headboard into the fastening channels, and wherein the second headboard is attached to the fourth end by a plurality of fastening means which extend through the second headboard into the fastening channels.

3. The terrace canopy according to claim 1, wherein said part of the continuous profile is L-shaped in the cross-section of the continuous profile.

4. The terrace canopy according to claim 1, wherein each of the ends defines a plane, which planes are mutually substantially parallel and are substantially perpendicular to a longitudinal direction of the beam.

5. A terrace canopy comprising:

a column;

a beam extending between a first end and a second end, wherein the beam is supported by the column at a location between said ends and wherein the beam, at said location, is provided with a recess, which recess divides the beam into a first and a second beam portion, wherein the first beam portion extends between the first end and a third end and the second beam portion extends between the second end and a fourth end, wherein the recess is located between the third end and the fourth end; and fastening means between the beam and the column for securing the beam to the column, the fastening means comprising:

a first headboard secured onto said third end and onto said column; and a second headboard secured onto said fourth end and onto said column, wherein the column comprises a connection element and a support column, which connection element is secured to the support column and to said headboards, and wherein the connection element is located substantially entirely in the recess in the beam.

6. The terrace canopy according to claim 5, wherein the connection element exhibits a rotational symmetry of order three or four.

7. The terrace canopy according to claim 5, wherein the connection element comprises an upper part to which the headboards are secured, wherein at least one support legs extend from the upper part to the support column and is secured thereto.

8. The terrace canopy according to claim 7, wherein the first and/or the second beam portion is provided with a gutter for discharging precipitation falling on the terrace canopy, to the third end and the second beam portion is provided with a gutter for discharging precipitation falling on the terrace canopy to the fourth end.

9. The terrace canopy according to claim 8, wherein the first and second headboards are provided with a passage and the connection element is provided with a first and a second passage, which passages allows a gutter of the first beam portion to communicate with a gutter of the second beam portion.

10. The terrace canopy according to claim 8, wherein the support column is provided with a cavity for discharging precipitation falling on the terrace canopy towards a ground surface, wherein the first and/or the second headboard is are provided with a passage and wherein the connection element is provided with a first passage and a second passage, the first passage allows a gutter of the first, beam portion to communicate with the cavity of the support column and which second passage allows a gutter of the second beam portion to communicate with the cavity of the support column.

11. The terrace canopy according to claim 5, wherein the connection element comprises an upper part to which the headboards are secured, which upper part of the connection element is provided with at least two wall portions, wherein each headboard is attached against a wall portion of the connection element, wherein mutually cooperating alignment means are provided between each wall portion and the headboard attached thereto, wherein mutually cooperating alignment means are configured for aligning a headboard with respect to the support column and which mutually cooperating alignment means comprise a tongue and groove.

12. The terrace canopy according to claim 11, wherein the tongue and the groove have mutual contact surfaces which are oriented obliquely with respect to the corresponding wall portion.

13. The terrace canopy according to claim 5, wherein each headboard is provided with at least one bolt opening and in that the connection element is provided with a corresponding bolt opening, which bolt openings are configured for attaching a headboard on the connection element.

14. A method of producing a terrace canopy comprising:

a column;

a beam extending between a first end and a second end, wherein the beam is supported by the column at a location between said ends and wherein the beam, at said location, is provided with a recess, which recess divides the beam into a first and a second beam portion, wherein the first beam portion extends between the first end and a third end and the second beam portion extends between the second end and a fourth end, wherein the recess is located between the third end and the fourth end; and fastening means between the beam and the column for securing the beam to the column, the fastening means comprising:

a first headboard secured onto said third end and onto said column; and a second headboard secured onto said fourth end and onto said column, wherein the column comprises a connection element and a support column, which connection element is secured to the support column and to said headboards, wherein the method comprises:

providing the beam, the support column, the headboards and the connection element;

producing the recess in the beam;

attaching the headboards onto the third and fourth ends;

placing the support column on a ground surface;

attaching the connection element onto the support column;

placing the beam on the support column; and attaching the headboards to the connection element.

* * * * *